US007938155B2

(12) United States Patent
Maietta et al.

(10) Patent No.: US 7,938,155 B2
(45) Date of Patent: May 10, 2011

(54) RING STRANDER KNIFE ASSEMBLY AND METHOD OF USE

(75) Inventors: Anthony Maietta, Worcester, MA (US); Jeremy Dexter, Templeton, MA (US); Timothy House, Langley (CA)

(73) Assignee: Simonds International Corporation, Fitchburg, MA (US)

( * ) Notice: Subject to any disclaimer, the term of this patent is extended or adjusted under 35 U.S.C. 154(b) by 271 days.

(21) Appl. No.: 12/040,480

(22) Filed: Feb. 29, 2008

(65) Prior Publication Data

US 2009/0217794 A1 Sep. 3, 2009

(51) Int. Cl.
*B27C 1/00* (2006.01)

(52) U.S. Cl. ..... 144/162.1; 144/218; 144/220

(58) Field of Classification Search ..... 144/162.1, 144/172, 218, 220, 174; 241/91, 92, 292.1, 241/278.1, 298; 407/37, 44, 41, 66, 94, 108
See application file for complete search history.

(56) References Cited

U.S. PATENT DOCUMENTS

| | | | | |
|---|---|---|---|---|
| 2,093,874 A | | 9/1937 | Stargardter | |
| 2,388,799 A | | 11/1945 | Payzer et al. | |
| 3,315,548 A | | 4/1967 | Anderson et al. | |
| 3,600,816 A | | 8/1971 | Watanabe et al. | |
| 3,854,511 A | | 12/1974 | Maier | |
| 4,232,096 A | | 11/1980 | Franzen et al. | |
| 4,298,044 A | | 11/1981 | Hansel et al. | |
| 4,660,777 A | * | 4/1987 | Schaefer et al. | 241/88 |
| 4,750,387 A | | 6/1988 | Swiger | |
| 4,784,337 A | | 11/1988 | Nettles et al. | |
| 5,129,437 A | | 7/1992 | Nettles et al. | |
| 5,271,442 A | * | 12/1993 | Carpenter et al. | 144/220 |
| 5,333,659 A | | 8/1994 | Carpenter et al. | |
| 5,417,263 A | | 5/1995 | Jorgensen | |
| 5,456,300 A | * | 10/1995 | Rosenkranz et al. | 144/230 |
| 5,469,902 A | | 11/1995 | Sharp et al. | |
| 5,485,873 A | * | 1/1996 | Crammond | 144/162.1 |

(Continued)

FOREIGN PATENT DOCUMENTS

DE 1926777 A1 11/1970

(Continued)

OTHER PUBLICATIONS

Alliance Knife, Inc., Materials List, retrieved from the Internet on Dec. 19, 2007, URL: http://www.allianceknife.com/Products/Materials/materials.html, 1 page.

(Continued)

*Primary Examiner* — Shelley Self
(74) *Attorney, Agent, or Firm* — BainwoodHuang

(57) ABSTRACT

A cutting assembly includes a knife assembly having a knife holder and a knife blade, a counter knife, and a scoring tip holder. In one arrangement, the counter knife is secured to a ring strander drum, the knife holder and scoring tip holder are carried by a clamping element, and knife blade is disposed between the counter knife and the knife holder. In a closed position, the clamping element causes the knife and scoring tip holders to generate a compressive force against the counter knife, thereby securing the knife blade within the cutting assembly. In an open position, the clamping element positions the knife and scoring tip holders in a spaced relationship relative to the counter knife, thereby allowing removal of the knife blade from the cutting assembly. Accordingly, an operator can replace the knife blade in the cutting assembly without having to remove the entire cutting assembly from the ring strander device.

22 Claims, 11 Drawing Sheets

U.S. PATENT DOCUMENTS

| | | | | |
|---|---|---|---|---|
| 5,649,579 | A | 7/1997 | Kokko et al. | |
| 5,819,826 | A | 10/1998 | Schmatjen | |
| RE36,659 | E * | 4/2000 | Toogood | 144/220 |
| 6,484,770 | B1 | 11/2002 | Jonkka | |
| 6,701,627 | B2 | 3/2004 | Korb et al. | |
| 6,757,952 | B1 | 7/2004 | Stager | |
| 6,811,362 | B2 | 11/2004 | Wallin et al. | |
| 6,918,419 | B2 | 7/2005 | Wixey et al. | |
| 2002/0043297 | A1 * | 4/2002 | Stager et al. | 144/373 |
| 2004/0250899 | A1 | 12/2004 | Pallmann | |

FOREIGN PATENT DOCUMENTS

| | | | |
|---|---|---|---|
| DE | 2405465 | A1 | 8/1975 |
| DE | 3517539 | A1 | 11/1986 |
| DE | 4013050 | A1 | 10/1991 |
| DE | 19500408 | A1 | 7/1996 |
| DE | 19509664 | A1 | 9/1996 |
| EP | 0085040 | A2 | 8/1983 |
| EP | 0924039 | A2 | 6/1999 |
| EP | 1325798 | A1 | 7/2003 |
| GB | 2324499 | A | 10/1998 |
| WO | 2007053332 | A1 | 5/2007 |

OTHER PUBLICATIONS

International Search Report and Written Opinion from PCT/US2009/035091, mailed on Jul. 31, 2009.

* cited by examiner

RING STRANDER KNIFE ASSEMBLY AND METHOD OF USE

BACKGROUND

Oriented strand board (OSB) is a wood product formed from layered wafers of wood oriented in a particular pattern. For example, conventional OSB includes top and bottom layers of wood wafers with the longitudinal axes of the wafers aligned substantially parallel to a longitudinal axis of the board. Conventional OSB also includes a central layer disposed between the top and bottom layers with the longitudinal axes of wafers aligned substantially perpendicular to the longitudinal axis of the board.

As part of the OSB manufacturing process, manufacturers utilize waferizing machinery, such as ring strander devices or disk flaker devices to shave logs, such as aspen, yellow pine, or white birch, into thin wafers in a procedure termed waferizing. Taking ring strander devices as an example, typical ring strander devices include a clamping portion and a drum having between twenty-four and forty-four cutting assemblies disposed within the drum. In use, the log clamping portion receives a set of logs and secures a portion of the logs within the ring strander device such that a longitudinal axis of each log is substantially parallel to the axis of rotation of the drum. As the drum rotates, the clamping portion holds the logs against the cutting assemblies of the drum thereby allowing the cutting assemblies to shave the logs into wafers.

Ring strander devices can utilize different types of cutting assemblies to form the wood wafers. For example, one type of cutting assembly or knife pack, as manufactured by Simonds International Corporation, is illustrated in FIG. 1. The cutting assembly 10 is configured as a three-piece assembly including a plate knife 12, a counter knife 14, and a scoring tip holder 16. While a side view of the cutting assembly 10 is shown, the cutting assembly 10 has a length of about 28 inches. In use, as the cutting assembly rotates along direction 18, scoring tips held by the scoring tip holder 16, such as scoring tip 20, slice into the logs to define the lengths of the shavings produced by the ring strander, typically about 4 inches in length. A leading edge 22 of the plate knife 12 shaves wood from the logs where the thicknesses of the shavings are determined by a projection distance 24 of the plate knife 12 from the drum. Typically, the plate knife 12 produces shavings having a thickness of about 0.025 inches. As the plate knife 12 shaves the logs, the plate knife 12 directs the shavings along path 26 toward the counter knife 14. The counter knife 14, in turn, causes the shavings to break into wood wafers having a particular range of widths. For example, with a set back distance 28 of about 0.38 inches and a leading edge angle 30 of about 65°, the counter knife 14 causes the shavings to break into wood wafers or strands having a width of between about 1 inch and 2 inches.

SUMMARY

During operation, the cutting assemblies 10 of the ring strander devices become worn and, as a result, cannot effectively form the wood wafers. Accordingly, ring strander operators must change the cutting assemblies 10 multiple times per day. To change a cutting assembly 10, an operator unclamps and removes a worn cutting assembly 10 from the ring strander device. The operator then inserts a replacement cutting assembly 10 into the ring strander and clamps the replacement into place. The procedure is repeated for all of the cutting assemblies 10 disposed within the ring strander device drum. The operator transfers the worn cutting assemblies to a grinding area for resharpening of the knife plates.

Conventional cutting assemblies, however, suffer from a variety of deficiencies. Typically, the three components of a cutting assembly are secured together using a series of fasteners. Accordingly, during a replacement procedure, each cutting assembly in its entirety must be removed from the ring strander device. However, each cutting assembly weighs about 25 pounds, thereby making replacement of the worn cutting assemblies a cumbersome process to the operator. Additionally, because the cutting assemblies are relatively heavy, the replacement process can be time intensive causing the ring strander device to be inoperative for several hours.

Alternates to conventional cutting assemblies have been utilized in the OSB manufacturing process. For example, certain manufacturers have utilized keyed chipper knives, as produced by Key Knife Inc. (Key Knife Inc., Portland Oreg.) and as shown in U.S. Pat. No. 5,819,826, to form wood wafers in the OSB manufacturing process. The keyed chipper knives are relatively lightweight and can be replaced in the ring strander device. However, the key chipper knives do not include counter knives or appropriate counter knife geometry. Accordingly, during the shaving process, the keyed chipper knives can generate oversized wood wafers (i.e., termed postcards) that are unusable in the manufacture of OSB. Additionally, the keyed chipper knives can generate a relatively large amount of waste wood particles or fines as a result of inefficient formation of the wood wafers, thereby minimizing the amount of usable wood wafers formed in the waferizing process.

By contrast to conventional cutting assemblies such as used in ring strander devices, embodiments of the present invention relate to a cutting assembly that includes a removable and replaceable knife blade. The cutting assembly includes a knife assembly having a knife holder and a knife blade, a counter knife, and a scoring tip holder. The counter knife is secured to a ring strander drum, the knife holder and scoring tip holder are carried by a ring strander clamping element, and knife blade is disposed between the counter knife and the knife holder. In a closed position, the ring strander clamping element causes the knife holder and the scoring tip holder to generate a compressive force against the knife blade and counter knife, thereby securing the knife blade within the cutting assembly. In an open position, the ring strander clamping element positions the knife holder and the scoring tip holder in a spaced relationship relative to the counter knife, thereby allowing removal of the knife blade from the cutting assembly. With such a configuration of the cutting assembly, as the knife blade becomes dull, an operator can easily replace the knife blade in the cutting assembly without having to remove the entire cutting assembly from the ring strander device. Accordingly, use of the cutting assembly can reduce the amount of time required to replace the cutting elements, thereby reducing ring strander device downtime while allowing a manufacturer to maintain a suitable geometry of wood wafers for OSB manufacture and minimize creation of dust or fines.

In one arrangement, a cutting assembly includes a knife assembly having a knife holder, and a knife blade supported by the knife holder. The cutting assembly includes a counter knife opposing a first portion of the knife assembly. The counter knife has a leading edge defining a set back distance with the knife blade of the knife assembly where the set back distance constructed and arranged to provide a travel path for a wafer. The cutting assembly includes a scoring tip holder opposing a second portion of the knife assembly where the scoring tip holder is constructed and arranged to carry at least one scoring tip blade. The counter knife and the scoring tip holder are positionable between a first position relative to the knife assembly to secure the knife blade relative to the cutting assembly and a second position relative to the knife assembly to release the knife blade from the cutting assembly.

In one arrangement, a cutting assembly includes a knife assembly having a knife holder and a knife blade supported by the knife holder. The cutting assembly includes a counter knife opposing a first portion of the knife assembly. The counter knife has a leading edge defining a set back distance with the knife blade of the knife assembly, the set back distance being constructed and arranged to provide a travel path for a wafer. The cutting assembly includes a scoring tip holder opposing a second portion of the knife assembly. The scoring tip holder is constructed and arranged to carry at least one scoring tip blade. The cutting assembly includes a first coupling mechanism constructed and arranged to couple the counter knife to a drum of a ring strander device and a second a coupling mechanism disposed between the knife holder of the knife assembly and the scoring tip holder, the second coupling mechanism constructed and arranged to couple the knife holder to the scoring tip holder. The counter knife and the scoring tip holder are positionable between a first position relative to the knife assembly to secure the knife blade relative to the cutting assembly and a second position relative to the knife assembly to release the knife blade from the cutting assembly.

In one arrangement, a method for replacing a knife blade of a cutting assembly includes releasing a clamping pressure generated between a clamp of a ring strander device and a ring strander drum of the ring strander device from the cutting assembly. The method also includes positioning the clamp to dispose a knife assembly of the ring strander cutting assembly in a spaced apart relation relative to a counter knife of the ring strander cutting assembly, the knife assembly having a knife holder and the knife blade carried by the clamp and the counter knife carried by the ring strander drum. The method further includes removing the knife blade from the knife holder carried by the clamp.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention relate to a cutting assembly that includes a removable and replaceable knife blade. The cutting assembly includes a knife assembly having a knife holder and a knife blade, a counter knife, and a scoring tip holder. The counter knife is secured to a ring strander drum, the knife holder and scoring tip holder are carried by a ring strander clamping element, and knife blade is disposed between the counter knife and the knife holder. In a closed position, the ring strander clamping element causes the knife holder and the scoring tip holder to generate a compressive force against the knife blade and counter knife, thereby securing the knife blade within the cutting assembly. In an open position, the ring strander clamping element positions the knife holder and the scoring tip holder in a spaced relationship relative to the counter knife, thereby allowing removal of the knife blade from the cutting assembly. With such a configuration of the cutting assembly, as the knife blade becomes dull, an operator can easily replace the knife blade in the cutting assembly without having to remove the entire cutting assembly from the ring strander device. Accordingly, use of the cutting assembly can reduce the amount of time required to replace the cutting elements, thereby reducing ring strander device downtime while allowing a manufacturer to maintain a suitable geometry of wood wafers for OSB manufacture and minimize creation of dust or fines.

Figure 1:
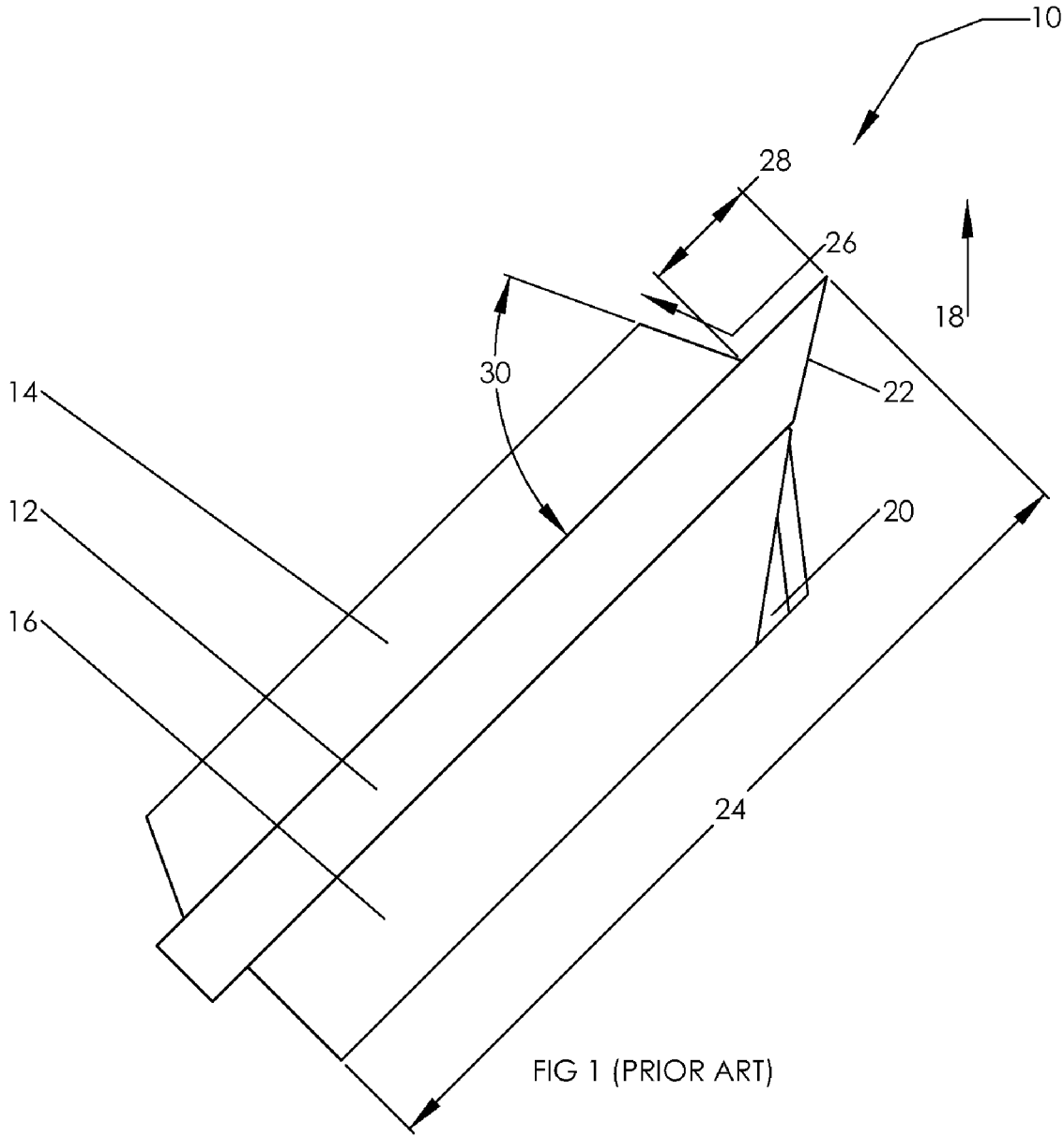
FIG 1 (PRIOR ART)
FIG. 1 illustrates a prior art cutting assembly for a ring strander device.
Figure 2:
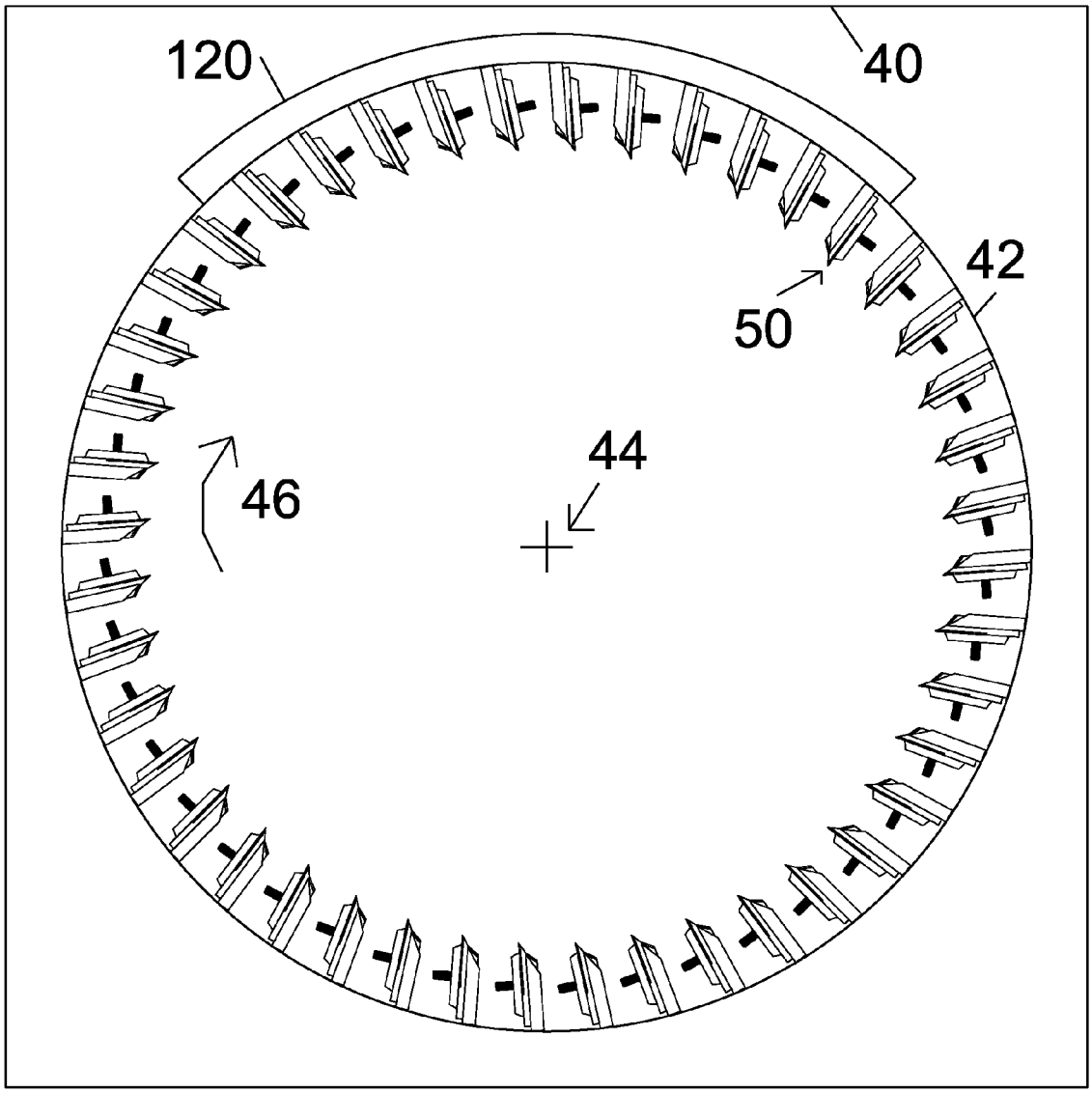
FIG. 2 illustrates a schematic representation of a ring strander device having a set of cutting assemblies disposed within a ring strander drum.

FIG. 2 is a schematic representation of a ring strander device 40 having a set of cutting assemblies 50 disposed within a ring strander drum 42. The ring strander device 40 is configured to shave logs, such as aspen or white birch, into thin wafers in a procedure termed waferizing. For example, as logs enter the ring strander device 40 along direction 44 (i.e., into the page) and as the ring strander drum 42 rotates clockwise along direction 46, the cutting assemblies 50 contact the logs and generate wood wafers for in the production of OSB. While a total of forty-four cutting assemblies 50 are illustrated as forming part of the ring strander device 40, it should be understood that any number of cutting assemblies can be used as part of the ring strander device 40.

Each cutting assembly 50 is configured to allow removal and replacement of a cutting element held by the cutting assembly 50 without requiring an operator to remove the entire cutting assembly from a ring strander device 40. Details of the components of the cutting assembly 50 are provided below.

Figure 3A:
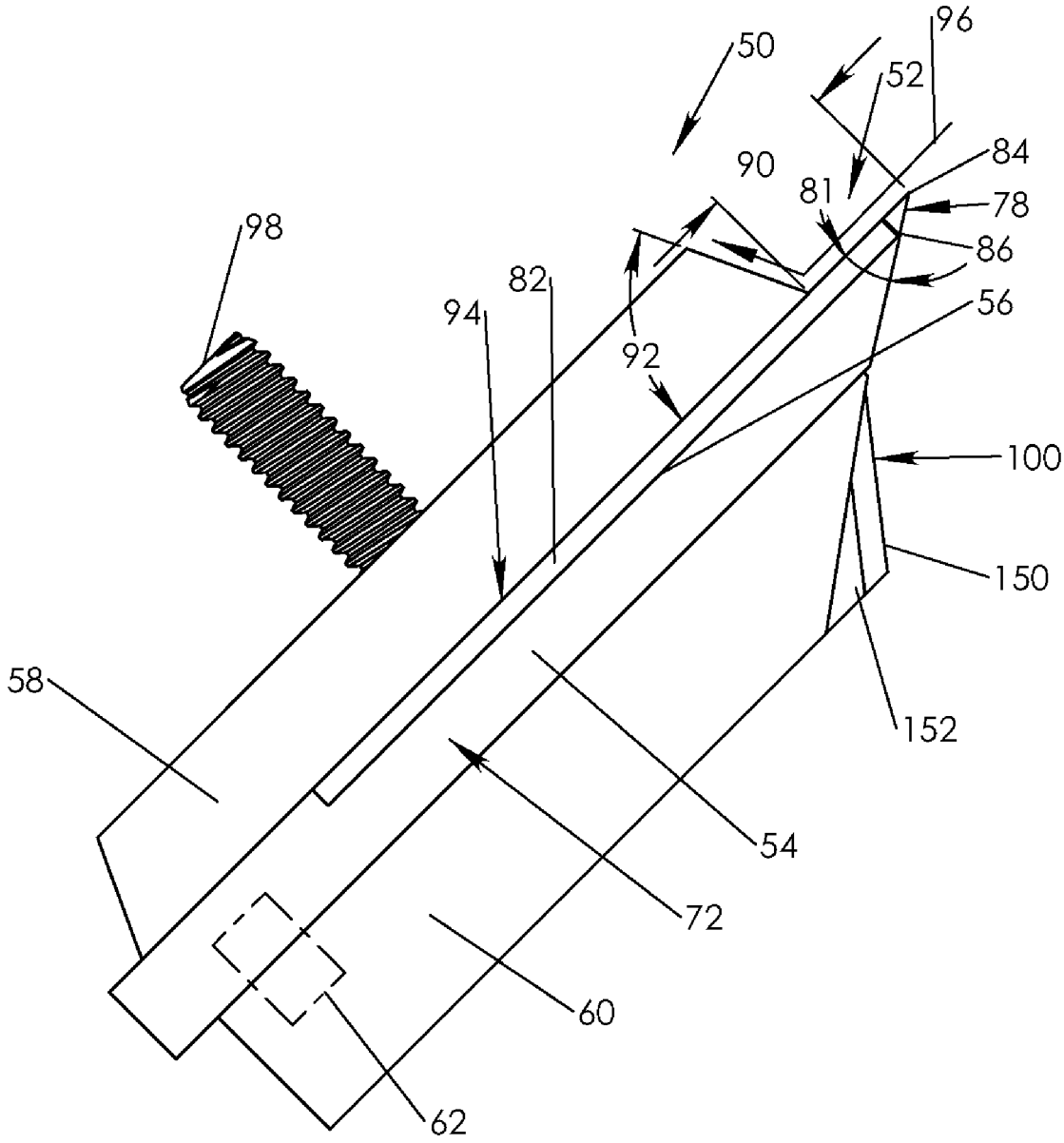
FIG. 3A illustrates a side view of a cutting assembly of FIG. 1, according to one embodiment.
Figure 3B:
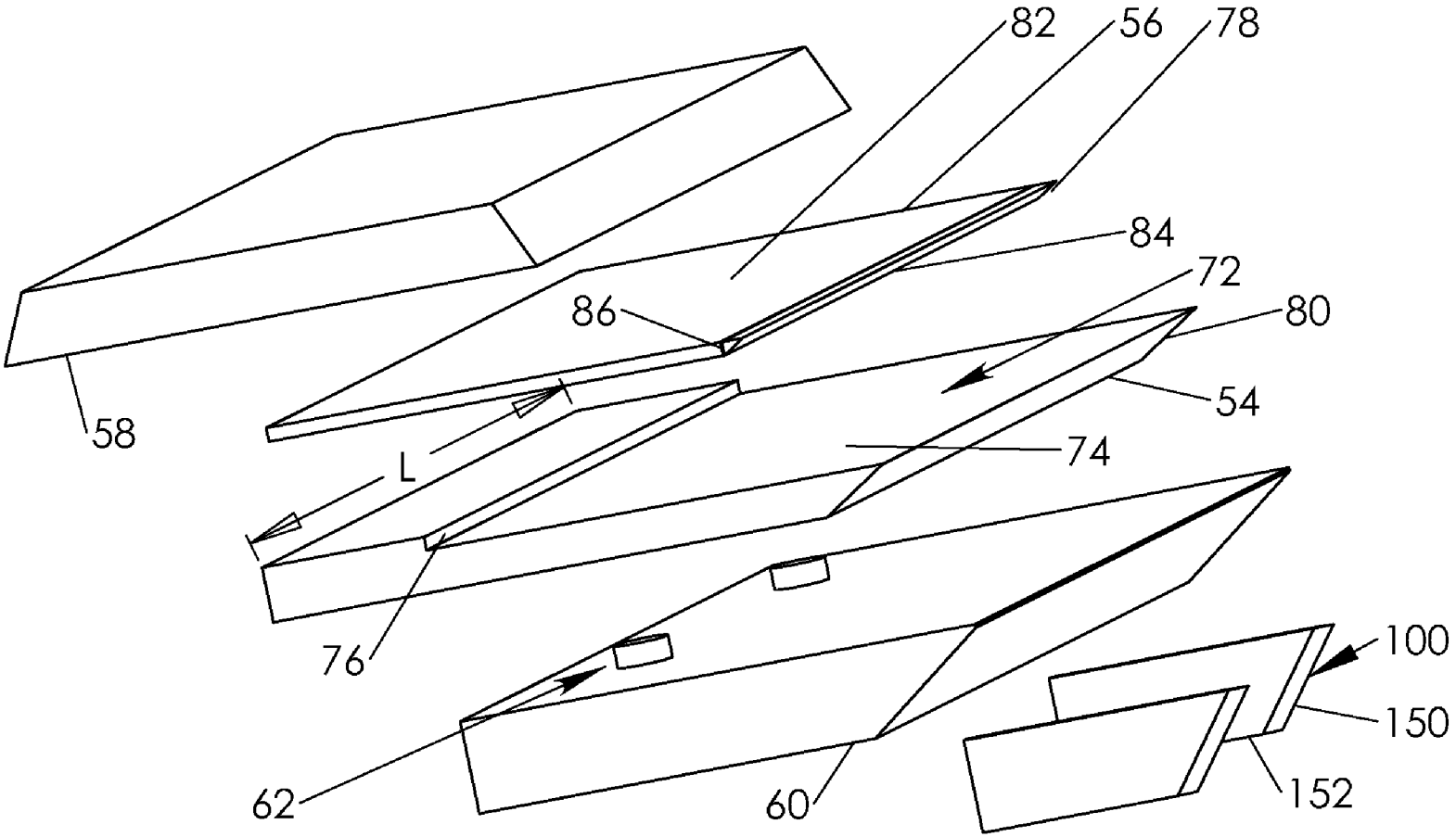
FIG. 3B illustrates an exploded view of the cutting assembly of FIG. 2A.

FIGS. 3A and 3B illustrate an arrangement of a cutting assembly 50, such as used in a ring strander device or a disc waferizer device. As illustrated, the cutting assembly 50 includes a knife assembly 52, a counter knife 58 and a scoring tip holder 60. As illustrated, the knife assembly 52 includes a knife holder 54 and a knife blade 56 carried by the knife holder 54.

The knife holder 54 defines a carrier portion 72 configured to carry the knife blade 56. In one arrangement, the carrier portion 72 extends along a length L of the knife holder is defined as a substantially L-shaped recess formed in the knife holder 54. For example, the carrier portion 72 includes a backing portion 74 and a base portion 76 which extend along the length L of the knife holder 54. The backing portion 74 and base portion 76 are configured to support a body portion of the knife blade 56 to minimize deflection or bending of the knife blade 56 during a cutting procedure. The carrier portion 72 is also configured to position a cutting edge 78 of the knife blade 56 relative to the cutting assembly 50 such that the cutting edge 78 extends beyond a distal edge 80 of the knife holder 54. Such a configuration allows the cutting edge 78 of the cutting assembly 50 to contact a work piece, such as a log, during operation of the ring strander device 40.

The knife blade 56 is configured to be easily inserted into and removed from the cutting assembly 50 while the cutting assembly is installed in the ring strander device 40. For example, while the knife blade 56 can be configured as having a variety of thicknesses, in one arrangement, the knife blade has a thickness of up to about 0.062. The relative thinness of the knife blade 56 reduces the overall weight of the knife blade, compared top conventional plate knives, and allows an operator to handle the knife blade 56 without requiring the use of excessive force. For example, the knife blade 56 weighs between about two pounds and three pounds.

In the arrangement illustrated, the knife blade 56 is formed as a bi-metal material. For example, the knife blade 56 includes a body portion 82 formed of a first material and a cutting or edge portion 84 formed of a second material and disposed along an edge of the body portion 82. While the body portion 82 can be formed from a variety of materials, in one arrangement, the body portion 82 is formed of a material having relatively high fatigue-resistance properties. For example, the body portion 82 can be formed from a medium carbon, low alloy steel, such as D6A, 6135 steel, or 6150 steel having a hardness of between about 42 and 48 HRC. Additionally, while the edge portion 84 can be formed from a variety of materials, in one arrangement, the edge portion 84 is formed from a material having relatively high wear-resistance properties. For example, the edge portion 84 can be formed from a high-speed steel material such as high-speed steel material M42 having a hardness of at least about 60 HRC and, in one arrangement, between about 63 and 70 HRC. The high-speed steel material helps to minimize wear of the knife blade 56 when used during the waferizing process.

The knife blade 56 includes a weld zone 86 disposed between the body portion 82 and the edge portion 84. For example, during the manufacturing process, an assembler secures the high-speed steel edge portion 84 to the body portion 82 using a welding technique, such as an electron welding technique. During the welding process, the high-speed steel edge portion 84 and the body portion 82 enter a lead lined vacuum chamber where a carbide guide pushes the edge portion 84 and the body portion 82 together. An electron source shoots beam of electrons at the interface of the body and edge portions 82, 84. The friction of the electrons passing between the portions 82, 84 heats the materials to melting temperatures and fuses the body and edge portions 82, 84 together at an interface termed the weld zone. The weld zone maintains the coupling of the body and edge portions 82, 84 during use of the knife blade 56. Once welded together, the assembler then grinds a bevel into the edge portion 84 of the knife blade 56. In one arrangement, the assembler grinds a bevel angle 81 of between about 30° and 35° relative to a planar surface 94 the knife blade 56. While an electron welding technique is described as being used to join the high-speed steel edge portion 84 and the body portion 82, alternate joining techniques can be used as well. For example, any form or welding or a permanent adhesive can be used to join the high-speed steel edge portion 84 and the body portion 82.

The counter knife 58 of the cutting assembly 50 is configured to cause the shavings generated by the knife blade 56 to break into wood wafers having a particular range of widths. For example, a distal portion or edge of the counter knife 58 defines a set back distance 90 of about 0.38 inches with the knife blade 56. Furthermore, the distal portion of the counter knife defines an angle 92 of between about 55° and 65° relative to a planar surface 94 of the knife blade 56. The set back distance 90 and the angle 92 define a travel path 96 for the shavings generated by the knife blade 56 which causes the shavings to break into wood wafers or strands having a width of between about 1 inch and 2 inches.

In one arrangement, the counter knife 58 is formed from a metal material and includes a coupling mechanism 98 configured to secure the counter knife 58 to the ring strander drum 42. For example, the coupling mechanism 98 can be a screw element which is matable with a correspondingly tapped hole formed in the ring strander drum 42. However, other coupling mechanisms 98, such as magnets, can be utilized.

The scoring tip holder 60 carries one or more scoring tips 100 that are configured to slice into a work piece, such as a log, to define the lengths of the shavings produced by the ring strander, typically about 4 inches in length. The scoring tip holder 60 also includes one or more fasteners 62 configured to secure the knife holder 54 to the scoring tip holder 60. The fasteners, such as screw elements, limit relative movement between the knife holder 54 and the scoring tip holder 60 during replacement of the knife blade 56.

Figure 4A:
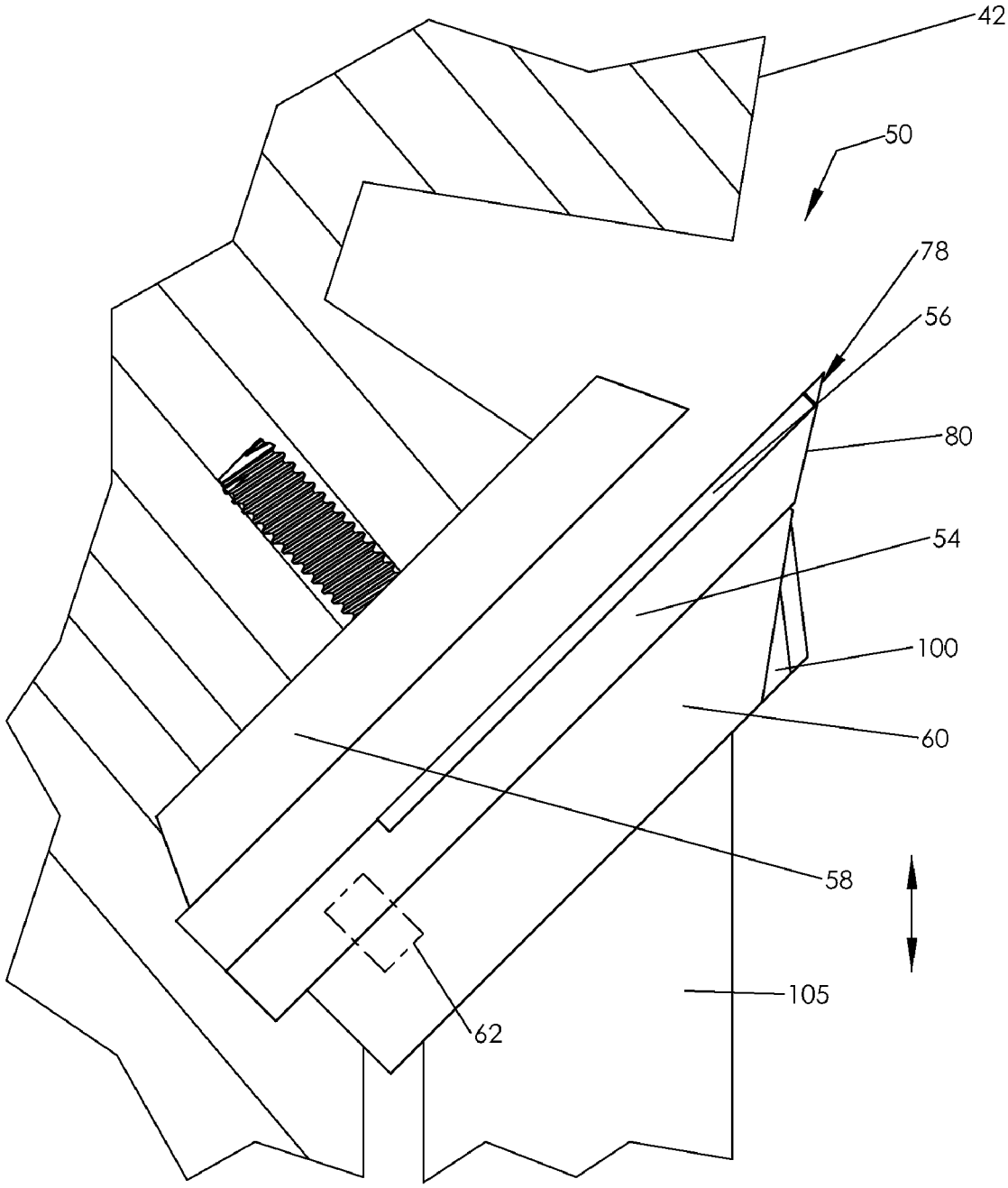
FIG. 4A illustrates the cutting assembly of FIGS. 3A and 3B disposed within a ring strander device in an open configuration.
Figure 4B:
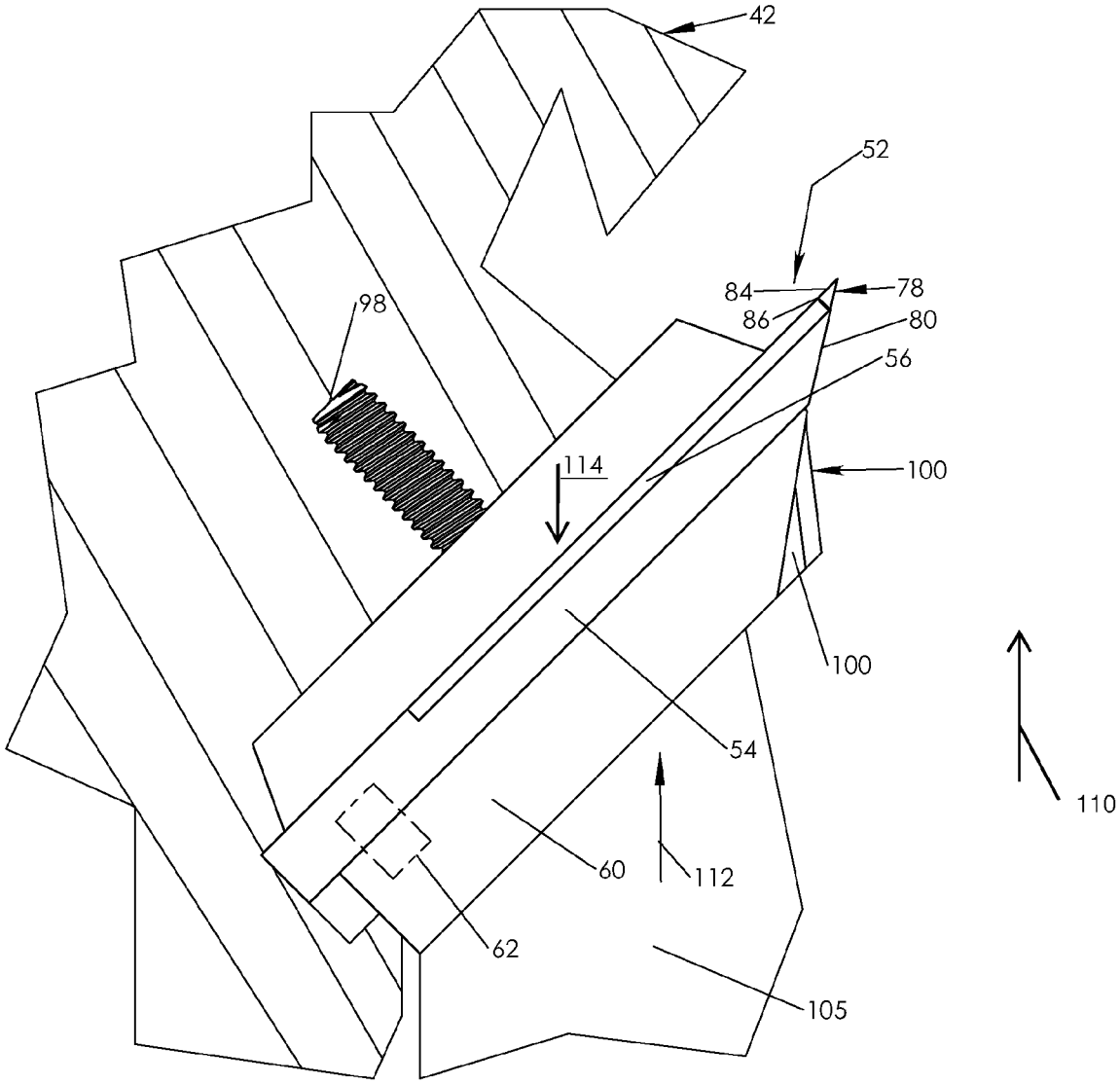
FIG. 4B illustrates the cutting assembly of FIGS. 3A and 3B disposed within a ring strander device in a closed configuration.

As indicated above, the configuration of the cutting assembly 50 allows and operator to remove and replace the knife blade 56 without requiring removal of the entire cutting assembly 50 from the ring strander device 40. FIGS. 4A and 4B illustrate the relative positioning of the elements of the cutting assembly 50 during the replacement process.

FIG. 4A illustrates the cutting assembly 50 disposed within a ring strander device 40 in an open position to allow installation of the knife blade 56 therein. For example, when installed within the ring strander device 40, the counter knife 58 is secured to the ring strander drum 42, and held in place, by the coupling mechanism 98. Also as shown, the knife holder 54 and scoring tip holder 60 are supported by a ring strander clamp 105 and the ring strander drum 42. In the open position, the clamp 105 disposes the knife holder 54 and scoring tip holder 60 in a spaced-apart relationship relative to the counter knife 58. Accordingly, an operator can remove or insert a knife blade 56 into the carrier portion 72 of the knife holder 54. After the operator has inserted the knife blade 56 into the knife holder 54, as shown, the operator must secure the knife blade 56 within the cutting assembly 50 prior to use.

In order to secure the knife blade 56 to the cutting assembly 50, as indicated in FIG. 4B, the operator positions the clamp 105 along a direction 110 to cause the knife holder 54 and scoring tip holder 60 to generate a compressive force 112 against the knife blade 56 and the counter knife 58. The counter knife 58, in turn, generates an opposing compressive force 114 against the knife blade 56, the knife holder 54 and the scoring tip holder 60. The opposing forces 112, 114 secure the knife blade 56 and the cutting assembly to the ring strander device 40.

During operation of the ring strander device 40, and with reference to FIG. 2, the ring strander drum 42 rotates about a central axis and a clamping portion (not shown) holds a work piece against the cutting assemblies 50 to allow the cutting assemblies 50 generate wood wafers, such as used in OSB manufacturing. While the knife blades 56 can include a high-speed steel cutting edge portion 84 to minimize wear of the knife blades 56, the knife blades 56 can become worn or dull during the waferizing process, thereby resulting in inefficient formation of wood wafers. An operator can detect dulling of the knife blades 56 based upon one or more factors. For example, an operator can detect dulling of the knife blades 56 by detecting a measured increase in the amperage drawn by the ring strander device motor. In another example, the operator can detect dulling of the knife blades 56 based upon a particular number of strokes or revolutions undertaken by the ring strander drum 42 or based upon a time duration of use of the knife blades 56.

In the event that the operator detects the knife blades 56 have become dull, the operator stops the rotation of the ring strander drum 42 and replaces each of the knife blades 56. Returning to FIG. 4A, to replace the knife blades 56, the operator releases the clamp 105 to space the knife holder 54 and scoring tip holder 60 away from the counter knife 58. The operator can then remove and replace the knife blades 56 from the cutting assemblies 50 without having to remove each, entire cutting assembly 50 from the ring strander device 40. The use of the cutting assembly 50 reduces the amount of time required, and the amount of effort exerted, by the operator to replace the cutting elements. Accordingly, the cutting assembly 50 reducing ring strander device 40 downtime while allowing a manufacturer to produce adequately sized wood wafers for OSB manufacture.

As indicated above, during operation, the ring strander drum 42 rotates about a central axis thereby causing the cutting assemblies 50 to generate wood wafers. As the ring strander drum 42 rotates, the ring strander drum generates a centrifugal force on the knife blades 56 to drive the knife blades 56 against the ring strander drum 42 to further secure the knife blades within the cutting assemblies 50. As an operator detects dulling of knife blades 56 during the waferizing process, the operator stops rotation of the ring strander drum 42 and, for each cutting assembly 50, the knife blades 56. However, referring to FIG. 2, with the ring strander drum 42 in a stationary position, in the event that the knife blades 56 disposed within the ring strander drum 42 within arc 120 are not securely held within the corresponding cutting assemblies 50, gravity can cause the knife blades 56 to become dislodged from and fall out of the cutting assemblies 50. To minimize the inadvertent decoupling of the knife blades 56 from the cutting assemblies 50, in one arrangement, each knife blade 56 includes an interlock portion configured to further secure the knife blade 56 with the corresponding cutting assembly 50.

Figure 5A:
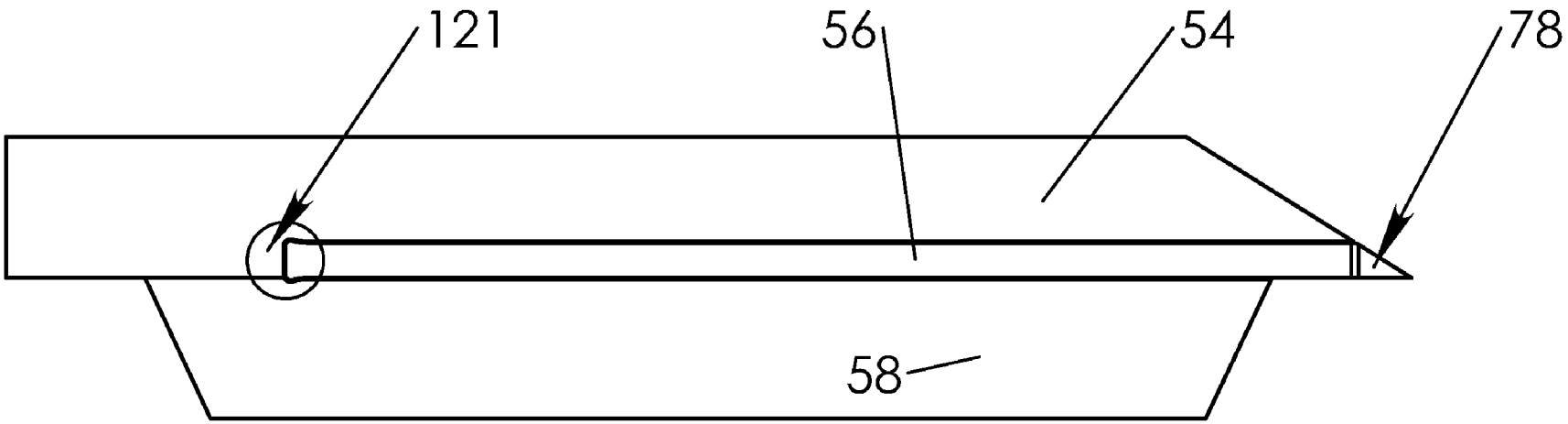
FIG. 5A illustrates a side view of a knife blade having a coupling portion disposed along a rear edge of the knife blade.
Figure 5B:
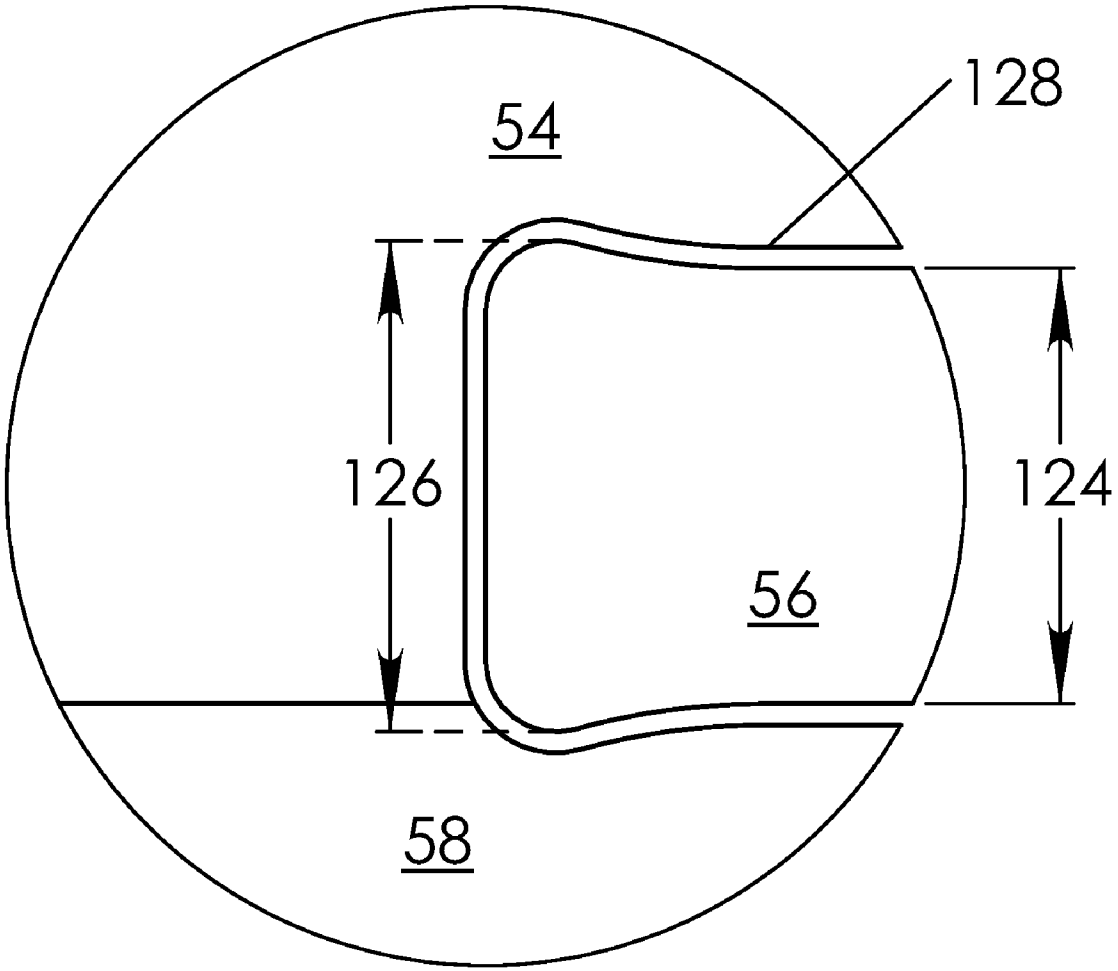
FIG. 5B illustrates the coupling portion of the knife blade of FIG. 4A.

FIGS. 5A and 5B illustrate one arrangement of an interlock portion 121 of a knife blade 56. As illustrated, the knife blade 56 includes a cutting edge 78 and a second, opposing edge 122 that is widened or mushroom-shaped relative to the thickness of the knife blade 56. For example, in the case where the knife blade 56 has a thickness 124 of about 0.062 inches, the opposing edge 122 has a thickness of about 0.070 inches. The widened opposing edge 122 inserts within a correspondingly or mirror-shaped channel or relief 128 defined by the knife holder 54 and the counter knife 58 to form an interference fit. Accordingly, with respect to FIG. 2, in the event that the knife blade 56 was disposed within a cutting assembly 50 located within the arc 120, interaction between the widened edge 122 and the relief 128 would limit or prevent the knife blade 56 from becoming dislodged from the cutting assembly 50.

Figure 6:
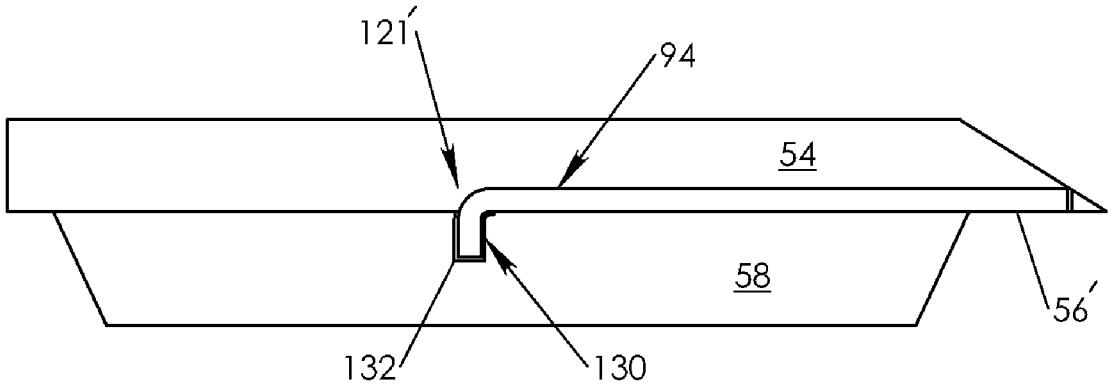
FIG. 6 illustrates a side view of a knife blade having a coupling portion disposed along a rear edge of the knife blade.

FIG. 6 illustrates an interlock portion 121' of a knife blade 56'. As illustrated, the knife blade 56' includes a cutting edge 78 and a second, opposing edge configured as an L-shaped member 130 extending substantially perpendicular to a planar surface 94 of the knife blade. The L-shaped member 130 inserts within either a correspondingly or mirror-shaped channel or relief 132 defined by the counter knife 58 as shown or within a channel or relief defined by the knife holder 54. Accordingly, with respect to FIG. 2, in the event that the knife blade 56' was disposed within a cutting assembly 50 located within the arc 120, interaction between the L-shaped member 130 and the relief 132 would limit or prevent the knife blade 56 from becoming dislodged from the cutting assembly 50.

While various embodiments of the invention have been particularly shown and described, it will be understood by those skilled in the art that various changes in form and details may be made therein without departing from the spirit and scope of the invention as defined by the appended claims.

Figure 7:
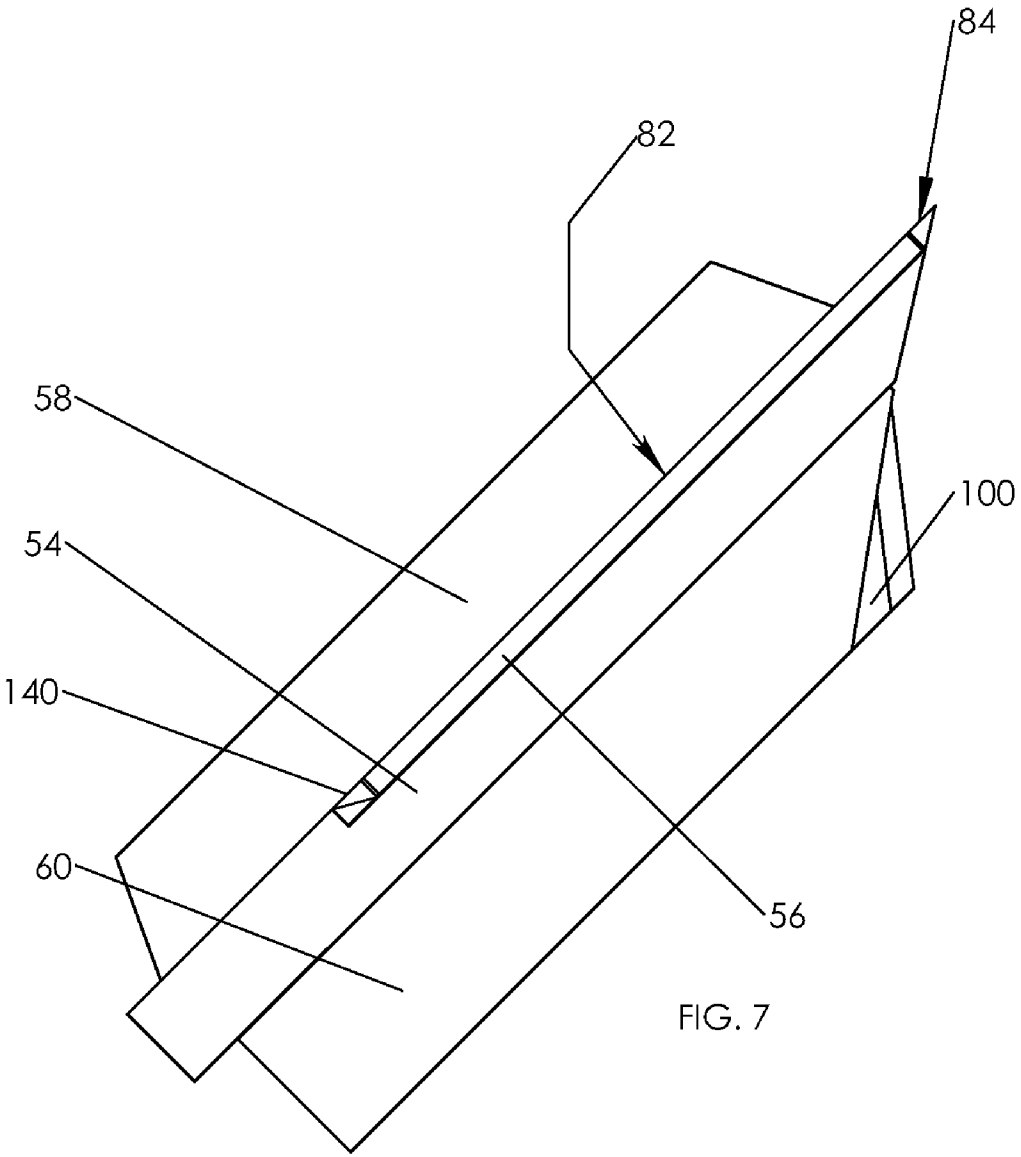
FIG. 7 illustrates a side view of a cutting assembly of FIG. 1, according to one embodiment.

For example, the knife blade 56 is illustrated as having a single cutting edge portion 84. Such description is by way of example only. In one arrangement as illustrated in FIG. 7, the knife blade 56 includes the first cutting portion 84 disposed at a first edge of the body portion 82 and a second cutting portion 140 disposed along a second opposing edge of the body portion 82. While the second cutting portion 140 can be formed from a variety of materials, in one arrangement, the second cutting portion is formed from a high-speed steel material having a hardness of at least about 60 HRC and, in one arrangement, between about 65 and 67 HRC. Use of the second cutting portion 140 as part of the knife blade 56 can reduce costs associated with replacing knife blades after wearing. For example, during a replacement procedure, an operator can remove the knife blade 56 from the cutting assembly 50, rotate the knife blade 56 by 180° to expose the second cutting portion 140 to the work piece, and reinsert and reclamp the knife blade 56 into the cutting assembly 50.

As indicated above, the cutting assembly 50 includes a separate knife holder 54 and scoring tip holder 60. Such description is by way of example only. In one arrangement, the knife holder 54 and the scoring tip holder 60 are integrally formed as a single piece.

As indicated above, the knife blade 56 can include an interlock portion 121 to help secure the knife blade 56 with a corresponding cutting assembly 50. The description of the widened back portion and L-shaped interlock portions were given as examples only. Other interlock mechanisms can be used to help secure the knife blade 56 with a corresponding cutting assembly 50. For example, dovetail joints, tongue and groove joints, magnetic interlocks, and adhesives can be utilized to help secure the knife blade 56 within the cutting assembly 50.

As indicated above, the edge portion 84 of the knife blade 56 can be formed from a high-speed steel material such as high-speed steel material M42. Such description is by way of example only. In one arrangement, the edge portion 84 can be formed from a high-speed steel material, such as an M-series, T-series, H-series, or D-series high-speed steel material.

Figure 8:
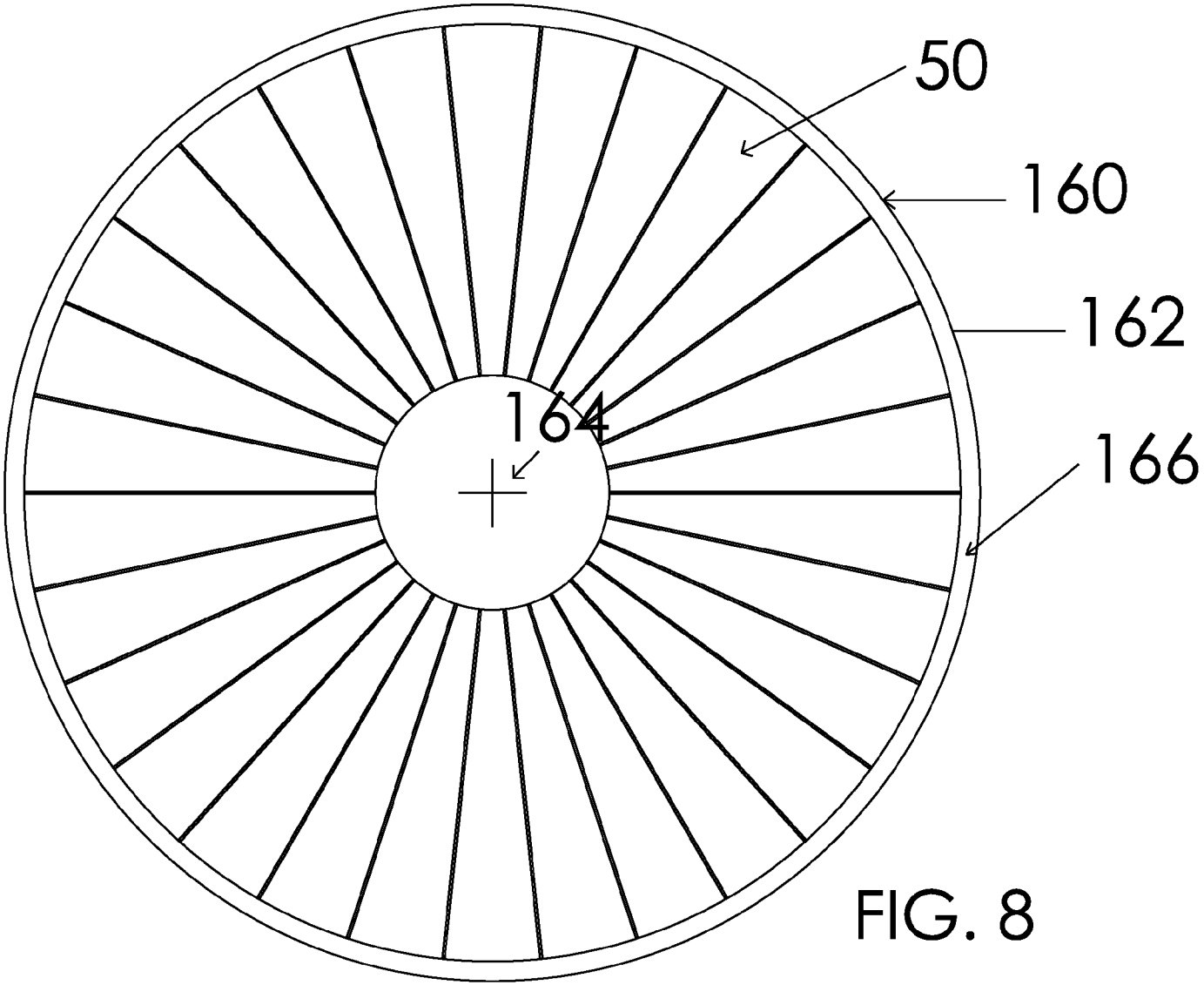
FIG. 8 illustrates a set of cutting assemblies disposed on a rotating disc of a disc flaker device.

As indicated above, and with reference to FIG. 2, the above-described cutting assemblies are utilized as part of a waferizing device, such as a ring strander device 40 where a set of cutting assemblies 50 are disposed within a ring strander drum 42. In one arrangement, as illustrated in FIG. 8, the cutting assemblies 50 are used as part of other waferizing devices, such as a disc flaker device 160. When used as part of a disc flaker device 160, each cutting assembly 50 is disposed on a rotating disc 162 of the disc flaker 160 such that each cutting assembly 50 extends from a center of rotation 164 of the rotating disc 162 to an outer periphery 166 of the rotating disc 162. In such an arrangement, the knife blade 82 of each cutting assembly 50 extends toward a work piece, such as one or more logs. In use, as the rotating disc 162 rotates and as the logs advance toward the rotating disc 162 (or as the rotating disc 162 advances toward the logs), the cutting assemblies 50 generate wood wafers from the logs as described in detail above.

As indicated above and with reference to FIGS. 3A and 3B, the scoring tip holder 60 carries one or more scoring tips 100 that are configured to slice into a work piece, such as a log. In one arrangement, the scoring tips 100 include a high speed steel cutting portion 150 disposed on scoring tip body portion 152, such as formed from a medium carbon, low alloy steel. The use of the high speed steel cutting portion 150 minimizes wearing of the scoring tips 100 during operation.

As indicated above, the counter knife 14 is formed from a metal material. Such description is by way of example only. In one arrangement, the counter knife 14 is formed from a plastic material, such as an injection molded plastic, having a distal edge formed from a metal material, such as a wear resistant (e.g., high speed steel). The use of the plastic material reduces the weight of the counter knife 14 thereby providing ease of handling to an operator.

What is claimed is:

1. A cutting assembly, comprising:

a knife assembly having:

a knife holder, and a knife blade supported by the knife holder;

a counter knife opposing a first planar surface of the knife assembly, the counter knife having a leading edge defining a set back distance with a leading edge of the knife blade of the knife assembly, the set back distance constructed and arranged to provide a travel path for a wafer; and a scoring tip holder opposing a second planar surface of the knife assembly, the second planar surface of the knife assembly opposing the first planar surface of the of the knife assembly, the scoring tip holder being configured to carry at least one scoring tip blade;

the counter knife and the scoring tip holder being configurable between (i) a first position relative to the knife assembly to secure the knife blade relative to the knife holder and (ii) a second position relative to the knife assembly to release the knife blade from the knife holder;

wherein the knife holder comprises a carrier portion having a backing portion and a base portion that define a substantially L-shaped recess extending along a longitudinal axis of the knife holder, the base portion configured to support a base of the knife blade, the base of the knife blade opposing a cutting edge of the knife blade, the carrier portion configured to position a cutting edge of the knife blade distal to a leading edge of the knife holder.

2. The cutting assembly of claim 1, wherein the knife blade comprises a body portion and a first cutting portion disposed along a first edge of the body portion, the first cutting portion being formed from a material having a hardness of at least about 60 HRC.

3. The cutting assembly of claim 1, wherein the knife blade comprises a body portion and a first cutting portion disposed along a first edge of the body portion, the first cutting portion is formed from a material having a hardness of between about 63 and 70 HRC.

4. The cutting assembly of claim 2, wherein the knife blade comprises a second cutting portion disposed along a second edge of the body portion, the second edge opposing the first edge, the second cutting portion being formed from a material having a hardness of at least about 60 HRC.

5. The cutting assembly of claim 2, wherein the knife blade comprises a second cutting portion disposed along a second edge of the body portion, the second edge opposing the first edge, the second cutting portion is formed from a material having a hardness of between about 63 and 70 HRC.

6. The cutting assembly of claim 1, wherein the knife blade comprises a body portion, a cutting portion disposed along a first edge of the body portion, and an interlock portion disposed at a second edge of the body portion, the second edge opposing the first edge.

7. The cutting assembly of claim 6, wherein the interlock portion has a first thickness, the first thickness being greater than a second thickness of the body portion, the interlock portion configured to be carried by at least a first relief defined by the knife holder.

8. The cutting assembly of claim 6, wherein the interlock portion comprises a member extending from the second edge substantially perpendicular to the body portion, the interlock portion configured to be carried by at least a first relief defined by the knife holder.

9. The cutting assembly of claim 1, wherein the counter knife comprises a coupling mechanism constructed and arranged to couple the counter knife to a rotating portion of a waferizing device.

10. The cutting assembly of claim 1, comprising a coupling mechanism disposed between the knife holder of the knife assembly and the scoring tip holder, the coupling mechanism constructed and arranged to couple the knife holder to the scoring tip holder.

11. A cutting assembly, comprising:

a knife assembly having:

a knife holder, and a knife blade supported by the knife holder;

a counter knife opposing a first planar surface of the knife assembly, the counter knife having a leading edge defining a set back distance with a leading edge of the knife blade of the knife assembly, the set back distance constructed and arranged to provide a travel path for a wafer;

a scoring tip holder opposing a second planar surface of the knife assembly, the second planar surface of the knife assembly opposing the first planar surface of the of the knife assembly, the scoring tip holder being configured to carry at least one scoring tip blade;

a first coupling mechanism constructed and arranged to couple the counter knife to rotating portion of a waferizing device; and a second a coupling mechanism disposed between the knife holder of the knife assembly and the scoring tip holder, the second coupling mechanism constructed and arranged to couple the knife holder to the scoring tip holder;

the counter knife and the scoring tip holder being configurable between (i) a first position relative to the knife assembly to secure the knife blade relative to the knife holder and (ii) a second position relative to the knife assembly to release the knife blade from the knife holder;

wherein the knife holder comprises a carrier portion having a backing portion and a base portion that define a substantially L-shaped recess extending along a longitudinal axis of the knife holder, the base portion configured to support a base of the knife blade, the base of the knife blade opposing a cutting edge of the knife blade, the carrier portion configured to position a cutting edge of the knife blade distal to a leading edge of the knife holder.

12. The cutting assembly of claim 11, wherein the knife blade comprises a body portion and a first cutting portion disposed along a first edge of the body portion, the first cutting portion being formed from a material having a hardness of at least about 60 HRC.

13. The cutting assembly of claim 12, wherein the knife blade comprises a second cutting portion disposed along a second edge of the body portion, the second edge opposing the first edge, the second cutting portion being formed from a material having a hardness of at least about 60 HRC.

14. The cutting assembly of claim 11, wherein the knife blade comprises a body portion, a cutting portion disposed along a first edge of the body portion, and an interlock portion disposed at a second edge of the body portion, the second edge opposing the first edge.

15. The cutting assembly of claim 14, wherein the interlock portion has a first thickness, the first thickness being greater than a second thickness of the body portion, the interlock portion configured to be carried by at least a first relief defined by the knife holder.

16. The cutting assembly of claim 14, wherein the interlock portion comprises a member extending from the second edge substantially perpendicular to the body portion, the interlock portion configured to be carried by at least a first relief defined by the knife holder.

17. The cutting assembly of claim 1, wherein the scoring tip holder comprises at least one scoring tip blade, the at least one scoring tip blade configured to slice into a workpiece to divide the wafer generated by the knife assembly into a set of sub-wafers, each sub-wafer of the set of sub-wafers defining a length that is less than a total length of the wafer.

18. The cutting assembly of claim 11, wherein the scoring tip holder comprises at least one scoring tip blade, the at least one scoring tip blade configured to slice into a workpiece to divide the wafer generated by the knife assembly into a set of sub-wafers, each sub-wafer of the set of sub-wafers defining a length that is less than a total length of the wafer.

19. The cutting assembly of claim 1, wherein, at a leading edge portion of the counter knife, the counter knife defines an angle of between about 55° and 65° relative to the a first planar surface of the knife assembly, the set back distance and the angle defining the travel path for the wafer generated by the knife blade, the travel path configured to break the wafer along a width of the wafer.

20. The cutting assembly of claim 11, wherein, at a leading edge portion of the counter knife, the counter knife defines an angle of between about 55° and 65° relative to the a first planar surface of the knife assembly, the set back distance and the angle defining the travel path for the wafer generated by the knife blade, the travel path configured to break the wafer along a width of the wafer.

21. A cutting assembly, comprising:

a knife assembly having:

a knife holder, and a knife blade supported by the knife holder;

a counter knife opposing a first planar surface of the knife assembly, the counter knife having a leading edge defining a set back distance with a leading edge of the knife blade of the knife assembly, the set back distance constructed and arranged to provide a travel path for a wafer; and a scoring tip holder opposing a second planar surface of the knife assembly, the second planar surface of the knife assembly opposing the first planar surface of the of the knife assembly, the scoring tip holder being configured to carry at least one scoring tip blade;

the counter knife and the scoring tip holder being configurable between (i) a first position relative to the knife assembly to secure the knife blade relative to the knife holder and (ii) a second position relative to the knife assembly to release the knife blade from the knife holder;

wherein the knife blade comprises a body portion, a cutting portion disposed along a first edge of the body portion, and an interlock portion disposed at a second edge of the body portion, the second edge opposing the first edge.

22. A cutting assembly, comprising:

a knife assembly having:

a knife holder, and a knife blade supported by the knife holder;

a counter knife opposing a first planar surface of the knife assembly, the counter knife having a leading edge defining a set back distance with a leading edge of the knife blade of the knife assembly, the set back distance constructed and arranged to provide a travel path for a wafer;

a scoring tip holder opposing a second planar surface of the knife assembly, the second planar surface of the knife assembly opposing the first planar surface of the of the knife assembly, the scoring tip holder being configured to carry at least one scoring tip blade;

a first coupling mechanism constructed and arranged to couple the counter knife to rotating portion of a waferizing device; and a second a coupling mechanism disposed between the knife holder of the knife assembly and the scoring tip holder, the second coupling mechanism constructed and arranged to couple the knife holder to the scoring tip holder;

the counter knife and the scoring tip holder being configurable between (i) a first position relative to the knife assembly to secure the knife blade relative to the knife holder and (ii) a second position relative to the knife assembly to release the knife blade from the knife holder;

wherein the knife blade comprises a body portion, a cutting portion disposed along a first edge of the body portion, and an interlock portion disposed at a second edge of the body portion, the second edge opposing the first edge.

* * * * *

UNITED STATES PATENT AND TRADEMARK OFFICE

CERTIFICATE OF CORRECTION

PATENT NO. : 7,938,155 B2
APPLICATION NO. : 12/040480
DATED : May 10, 2011
INVENTOR(S) : Anthony Maietta et al.

It is certified that error appears in the above-identified patent and that said Letters Patent is hereby corrected as shown below:

Claim 1, Column 9, Lines 38, "assembly opposing the first planar surface of the of the" should read -- assembly opposing the first planar surface of the --.

Claim 11, Column 10, Lines 42-46, "assembly opposing the first planar surface of the of the" should read -- assembly opposing the first planar surface of the --.

Claim 11, Column 10, Line 50, "a second a coupling mechanism disposed between the" should read -- a second coupling mechanism disposed between the --.

Claim 19, Column 11, Line 43, "angle of between about 55° and 65° relative to the a first" should read -- angle of between about 55° and 65° relative to the first --.

Claim 20, Column 11, Line 50, "angle of between about 55° and 65° relative to the a first" should read -- angle of between about 55° and 65° relative to the first --.

Claim 21, Column 12, Line 13, "assembly opposing the first planar surface of the of the" should read -- assembly opposing the first planar surface of --.

Claim 22, Column 12, Line 37, "assembly opposing the first planar surface of the of the" should read -- assembly opposing the first planar surface of --.

Claim 22, Column 12, Line 41, "couple the counter knife to rotating portion of a wafer-" should read -- couple the counter knife to a rotating portion of a wafer --.

Claim 22, Column 12, Line 43, "a second a coupling mechanism disposed between the" should read -- a second coupling mechanism disposed between the --.

Signed and Sealed this
Twelfth Day of July, 2011

David J. Kappos

David J. Kappos
*Director of the United States Patent and Trademark Office*